US010932037B2

(12) United States Patent
Winton et al.

(10) Patent No.: US 10,932,037 B2
(45) Date of Patent: Feb. 23, 2021

(54) LOUDSPEAKER SYSTEM AND CONFIGURATIONS FOR DIRECTIONALITY AND DISPERSION CONTROL

(71) Applicant: Harman International Industries, Incorporated, Stamford, CT (US)

(72) Inventors: Riley Winton, Canton, MI (US); Chris Ludwig, Birmingham, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 15/982,971

(22) Filed: May 17, 2018

(65) Prior Publication Data

US 2018/0338204 A1 Nov. 22, 2018

Related U.S. Application Data

(60) Provisional application No. 62/508,314, filed on May 18, 2017.

(51) Int. Cl.

| | |
|---|---|
| ***H04R 1/34*** | (2006.01) |
| ***H04R 5/02*** | (2006.01) |
| ***H04R 1/02*** | (2006.01) |

(52) U.S. Cl.

CPC ..... *H04R 1/345* (2013.01); *H04R 5/02* (2013.01); *H04R 1/023* (2013.01); *H04R 2499/13* (2013.01)

(58) Field of Classification Search

CPC ..... H04R 1/345; H04R 1/025; H04R 1/026; H04R 1/323; H04R 1/34; H04R 1/40;

(Continued)

(56) References Cited

U.S. PATENT DOCUMENTS 4,281,224 A * 7/1981 Castagna ..... B60R 11/0217 181/150
4,790,407 A * 12/1988 Yamamoto ..... H04R 1/2819 181/141

(Continued)

FOREIGN PATENT DOCUMENTS

JP 63287296 A * 11/1988
JP 11220790 A * 8/1999
JP 2016161440 A * 9/2016

*Primary Examiner* — Fan S Tsang
*Assistant Examiner* — Angelica M McKinney
(74) *Attorney, Agent, or Firm* — McCoy Russell LLP

(57) ABSTRACT

The present disclosure relates to loudspeaker systems and configurations. In one embodiment, a loudspeaker configuration includes a directional element coupled to the loudspeaker. The directional element can include a plurality of movable elements to passively direct output of the loudspeaker. Another embodiment is directed to a bidirectional loudspeaker having a first loudspeaker configured to output sound in a first direction, and a second loudspeaker configured to output sound in a second direction. The first loudspeaker and second loudspeaker may be arranged in a coaxial arrangement. Methods are provided for controlling a loudspeaker and a movable element. In one embodiment, a method includes detecting a control setting for at least one of a loudspeaker and a movable element associated with the loudspeaker. The method may also include controlling the movable element in response to the control setting including adjusting the movable element to direct output of the loudspeaker.

20 Claims, 4 Drawing Sheets

(58) Field of Classification Search
CPC .... H04R 1/2826; H04R 5/02; H04R 2499/15; H04R 25/402; B60R 2011/008; B60R 2011/0084; B60R 11/0217; H04B 1/082; H04B 1/086; H04S 7/302; H04S 7/301
See application file for complete search history.

(56) References Cited

U.S. PATENT DOCUMENTS 7,191,022 B1 * 3/2007 Kakuhari ..... H04R 5/02 381/80
9,315,159 B2 * 4/2016 Muller ..... B60J 5/0413
9,723,409 B2 * 8/2017 Smearcheck ..... H04R 7/045
2004/0035635 A1 * 2/2004 Nichols ..... B60R 11/0217 181/206
2006/0049664 A1 * 3/2006 Koa ..... B60J 5/0416 296/152
2008/0175405 A1 * 7/2008 Couvillon ..... H04R 5/02 381/86
2012/0140977 A1 * 6/2012 Hiramoto ..... H04R 9/06 381/412
2014/0086444 A1 * 3/2014 Muller ..... B60J 5/0413 381/389
2015/0030178 A1 * 1/2015 Sulowski ..... H04R 1/345 381/86
2015/0078580 A1 * 3/2015 Schwerdtfeger ..... H04R 1/323 381/86
2015/0086035 A1 * 3/2015 Shin ..... H04R 1/02 381/86
2016/0205479 A1 * 7/2016 Tomar ..... H04R 9/04 381/398
2017/0096099 A1 * 4/2017 Matsubara ..... B60Q 5/008
2017/0127165 A1 * 5/2017 Kanagaraj ..... H04R 1/025
2019/0075392 A1 * 3/2019 Kinoshita ..... H04R 1/2834

* cited by examiner

LOUDSPEAKER SYSTEM AND CONFIGURATIONS FOR DIRECTIONALITY AND DISPERSION CONTROL

CROSS-REFERENCE TO RELATED APPLICATION

This application claims priority to U.S. Provisional Application No. 62/508,314 filed on May 18, 2017 and titled LOUDSPEAKER SYSTEM AND CONFIGURATIONS FOR DIRECTIONALITY AND DISPERSION CONTROL, the content of which is expressly incorporated by reference in its entirety.

FIELD

The present disclosure relates to loudspeaker systems and configurations, and more particularly to vehicle loudspeaker systems and configurations for directionality and dispersion control.

BACKGROUND

Modern vehicle acoustic systems use a variety of speakers and speaker configurations. For desired sound quality and performance, implementation of speakers with existing configurations requires a substantial amount of space in the vehicle, especially for subwoofer speakers. There exists a desire to provide significant performance improvements and savings in weight and volume occupied by speaker systems. There also exists a desire for improved directionality within and external to vehicles.

BRIEF SUMMARY OF THE EMBODIMENTS

Disclosed and claimed herein are methods, devices and systems for loudspeakers and loudspeaker control. In one embodiment, a loudspeaker configuration includes a loudspeaker, and a directional element coupled to the loudspeaker. In one embodiment, the directional element includes a plurality of movable elements configured for passive directivity of output of the loudspeaker based on the positioning of the movable elements.

In one embodiment, the directional element includes a housing and a plurality of uniform elements arranged in the housing, wherein elements of the directional element are configured to rotate to a left position, center position, and right position.

In one embodiment, the directional element includes a moveable louver system mounted to the loudspeaker, the movable louver system including a plurality of parallel slat elements configured to be positioned in a plurality of positions, wherein the plurality of slat elements are configured to direct sound output by the loudspeaker based on the position of slat elements.

In one embodiment, the plurality of movable elements move as a unit to direct output of the loudspeaker in at least one direction.

In one embodiment, the directional element is mounted to a cone of the loudspeaker and wherein the directional element includes a plurality of movable elements configured based on the shape of the cone, and wherein the plurality of movable elements provide a waveguide for audio output of the loudspeaker to provide passive directivity through acoustic dispersion.

In one embodiment, the loudspeaker includes a second loudspeaker configured to output sound in a second direction, wherein the second loudspeaker is arranged in a coaxial arrangement with the loudspeaker and directional element.

Another embodiment is directed to bidirectional loudspeaker. In one embodiment, the bidirectional loudspeaker includes a first loudspeaker configured to output sound in a first direction. The bidirectional loudspeaker also includes a second loudspeaker configured to output sound in a second direction, wherein the first loudspeaker and second loudspeaker are arranged in a coaxial arrangement.

In one embodiment, the bidirectional speaker is configured for operation in a vehicle with the first loudspeaker configured to output sound to a vehicle interior and wherein the second loudspeaker is configured to output sound to the vehicle exterior.

In one embodiment, the second loudspeaker is configured to output environmental sound outside of the vehicle.

In one embodiment, the bidirectional speaker is configured to operate with a movable element for the second loudspeaker.

In one embodiment, the movable element provides speaker venting for the second loudspeaker in a vehicle door.

In one embodiment, the first loudspeaker includes moveable louver system mounted to the first loudspeaker, the movable louver system including a plurality of parallel slat elements configured to be positioned in a plurality of positions, wherein the plurality of slat elements are configured to direct sound output by the first loudspeaker based on the position of slat elements.

In one embodiment, the first loudspeaker includes an acoustic horn to direct sound inside of a vehicle, and the second loudspeaker includes an acoustic horn to direct sound outside of a vehicle.

In one embodiment, a motor structure of the first loudspeaker is coupled to the motor structure of the second loudspeaker.

In one embodiment, the first direction associated with the loudspeaker is opposite the second direction associated with the second loudspeaker.

One embodiment is directed to a method for controlling a loudspeaker and a movable element. The method includes detecting a control setting for at least one of a loudspeaker and a movable element associated with the loudspeaker. The method also includes controlling the movable element in response to the control setting, wherein the movable element is adjusted to direct output of the loudspeaker.

In one embodiment, controlling the movable element includes controlling a plurality of uniform elements arranged in the housing to rotate to a left position, center position, and right position.

In one embodiment, controlling the movable element includes controlling a moveable louver system mounted to the loudspeaker, the louver system including a plurality of parallel slat elements configured to be positioned in a plurality of positions, wherein the plurality of slat elements are configured to direct sound output by the loudspeaker based on the position of slat elements.

In one embodiment, controlling the movable element of the loudspeaker is configured to operate with a sliding door the second loudspeaker.

In one embodiment, controlling includes controlling output of an outward facing sound element of a bidirectional speaker.

Other aspects, features, and techniques will be apparent to one skilled in the relevant art in view of the following detailed description of the embodiments.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

One aspect of the disclosure is directed to vehicle systems and configurations for loudspeakers and loudspeaker configurations for directionality and dispersion control. In one embodiment, a system is provided to control speakers and speaker elements. The system may include movable elements to allow for sound to be dispersed externally of a vehicle. In other embodiments, directional elements may be provided to direct sound within a vehicle cabin.

In one embodiment, a loudspeaker configuration is directed to a bidirectional speaker configuration including a modified coaxial arrangement with two speaker cones.

Another embodiment is directed to a speaker venting a mechanism to allow for speaker output to more easily disperse from a vehicle door panel. The venting system allows for in-vehicle acoustic systems to utilize externally coupled subwoofer solutions (ECS), where the front of the woofer cone is acoustically presented to vehicle occupants, while the back of the cone acoustically "sees" the outside world.

Another embodiment is directed a directional speaker arrangement including directional element having a plurality of movable elements. The directional element allows for passive directivity of a loudspeaker to be changed to automatically to address changing needs of the user.

Other embodiments are directed to processes for speaker control. In one embodiment, a process is provided for controlling a loudspeaker and a movable element. A control setting may be detected for at least one of a loudspeaker and a movable element associated with the loudspeaker. The movable element may be controlled in response to the control setting such that the movable element is adjusted to direct output of the loudspeaker As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

Exemplary Embodiments

Figure 1:
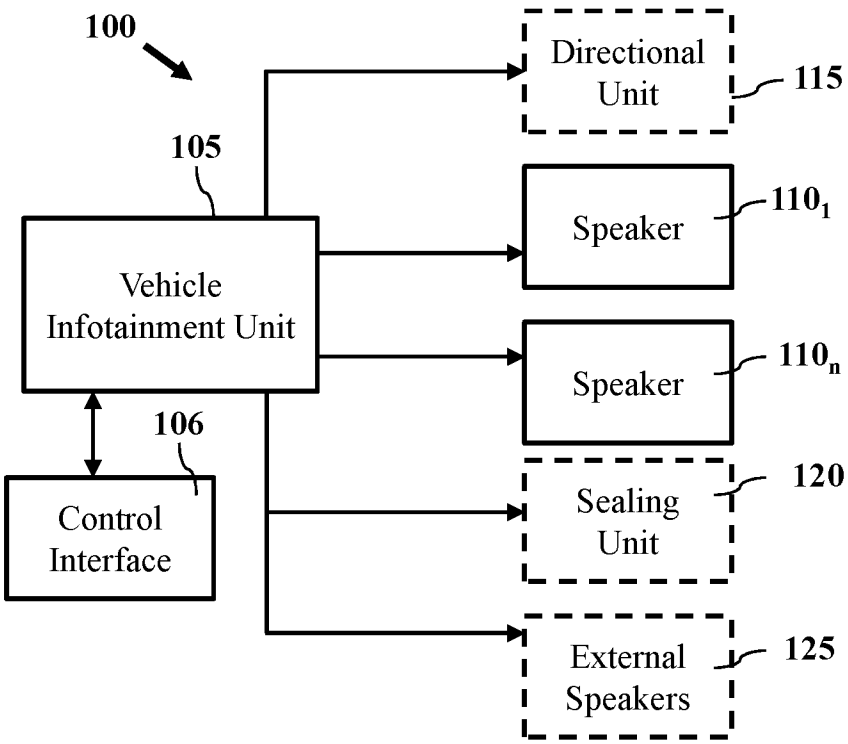
FIG. 1 depicts a graphical representation of a system according to one or more embodiments.

Referring now to the figures, FIG. 1 depicts a graphical representation of a system according to one or more embodiments. In one embodiment, system 100 is a vehicle infotainment system. System 100 includes vehicle infotainment unit 105 which may provide one or more of driver assistance, navigation, media and vehicle control features. In one embodiment, system 100 includes control interface 106 which may be employed to provide one or more commands to vehicle infotainment unit 105. Commands may be directed to output of media, speakers settings (e.g., equalizer settings, fade and left right control). Commands may also be directed to one or more of directionality and movable element control as described herein. Control interface 106 may include a display and one or more input controls, such as a touch screen display to present a user interface for vehicle infotainment unit 105, input and adjustment of commands and display.

According to one embodiment, vehicle infotainment unit 105 drives one or more speakers $\mathbf{110}_{1\text{-}n}$ of a vehicle. Speakers $\mathbf{110}_{1\text{-}n}$ may be loudspeakers and may be directed to one or more driver types including full range drivers, subwoofers, woofers, mid-range drivers, tweeters and coaxial drivers. According to another embodiment, and as will be discussed in more detail below, vehicle infotainment unit 105 may be configured to control one or more units associated with loudspeakers $\mathbf{110}_{1\text{-}n}$, such as optional directional unit 115 and optional sealing unit 120. According to another embodiment, speakers $\mathbf{110}_{1\text{-}n}$ may relate to a bidirectional speaker as discussed herein.

According to one embodiment, vehicle infotainment unit 105 includes a processor or control to perform one or more functions which may be stored in a memory vehicle infotainment unit 105. Vehicle infotainment unit 105 may perform one or more processes described herein for control of vehicle.

According to another embodiment, system 100 may relate to a media system such as the vehicle audio system configured to control one or more loudspeakers and output of media to the speakers. Accordingly, system 100 may not require functionality associated with driver assistance or navigation (e.g., global positioning service (GPS)) in certain embodiments.

Figure 2:
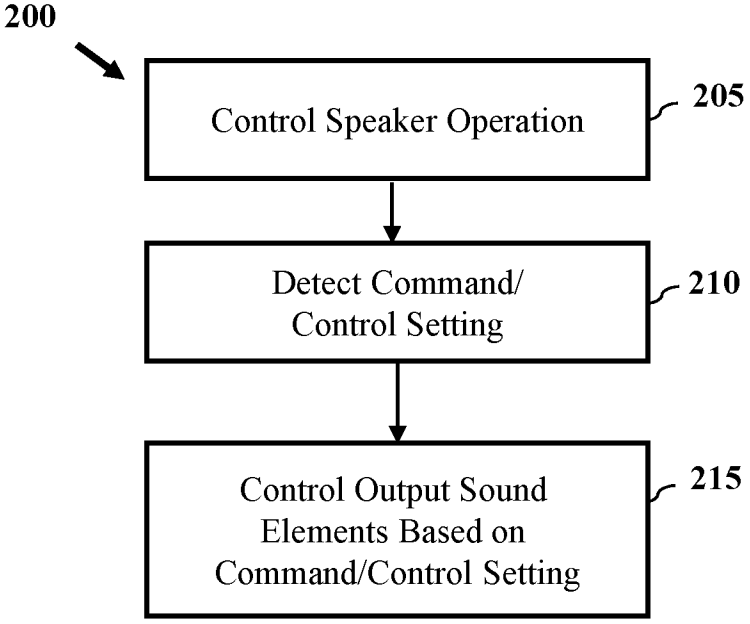
FIG. 2 depicts a process for speaker control according to one or more embodiments.

FIG. 2 depicts a process for speaker control according to one or more embodiments. According to one embodiment, process 200 may be performed for controlling a loudspeaker and a movable element. Process 200 may be employed by a device, such as the vehicle infotainment unit (e.g., vehicle infotainment unit 105) or a vehicle control unit (e.g., media player, etc.) of a vehicle system (e.g., system 100). At block 205, control setting can be detected for at least one of a loudspeaker and a movable element associated with the loudspeaker. According to one embodiment, process 200 may be initiated by the vehicle infotainment unit controlling speaker operation at block 205. At block 210, one or more commands or control settings may be detected associated with vehicle components. For example, a movable element may be controlled in response to the control setting at block 210, such that the movable element is adjusted to direct output of the loudspeaker. The vehicle infotainment unit may control the output of sound elements including speakers and other units based on the detected command and/or control setting at block 215.

Figure 3:
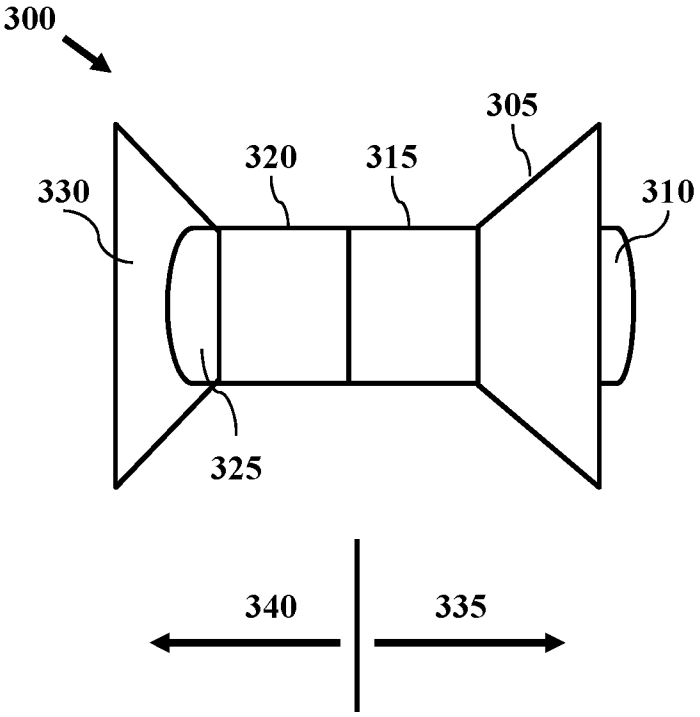
FIG. 3 depicts a graphical representation of a bidirectional speaker configuration according to one or more embodiments.

In one embodiment, commands and controls at blocks 210 and 215 relate to commands associated with a movable element of the vehicle for control of sound external the vehicle, such as a sealing unit (e.g., optional sealing unit 120). According to another embodiment, commands and controls at blocks 210 and 215 relate to directionality of speaker elements within a vehicle such as an optional directional unit (e.g., an optional directional unit 115). In one embodiment, controlling the movable element includes controlling a plurality of uniform elements arranged in the housing to rotate to a left position, center position, and right position. According to another embodiment, controlling the movable element includes controlling a moveable louver system mounted to the loudspeaker, the louver system including a plurality of parallel slat elements configured to be positioned in a plurality of positions, wherein the plurality of slat elements are configured to direct sound output by the loudspeaker based on the position of slat elements. Controlling can include controlling output of the movable element of the bidirectional speaker is configured to operate with a sliding door the second loudspeaker. Control can include controlling an outward facing sound element of a bidirectional speaker. FIG. 3 depicts a graphical representation of a bidirectional speaker configuration according to one or more embodiments. According to one embodiment, speaker 300 is a bi-directional coaxial speaker configured to direct sound in two directions. According to one embodiment, speaker 300 is a bidirectional loudspeaker including a first loudspeaker configured to output sound in a first direction and a second loudspeaker configured to output sound in a second direction. According to another embodiment, the first loudspeaker and second loudspeaker are arranged in a coaxial arrangement.

In one embodiment, speaker 300 is a bidirectional speaker configured for operation in a vehicle with the first loudspeaker configured to output sound to a vehicle interior and wherein the second loudspeaker is configured to output sound to the vehicle exterior. The second loudspeaker may be configured to output environmental sound outside of the vehicle, such as sound of the vehicle. Speaker 300 may be configured to operate with a movable element for the second loudspeaker as will be described with reference to FIG. 4. The movable element can provide speaker venting for the second loudspeaker in a vehicle door. The first loudspeaker can include an acoustic horn to direct sound inside of a vehicle, and the second loudspeaker can include an acoustic horn to direct sound outside of a vehicle According to one embodiment, speaker 300 may include a first loudspeaker that includes moveable louver system mounted to the first loudspeaker. The movable louver system can include a plurality of parallel slat elements configured to be positioned in a plurality of positions. The plurality of slat elements are configured to direct sound output by the first loudspeaker based on the position of slat elements.

According to one embodiment bidirectional speaker 300 includes a modified coaxial speaker with 2 speaker cones, such that one cone fires forward in a traditional manner, with one additional speaker cone firing rearward. This allows full performance in the traditional forward direction, but also enables environmental sound to be generated outside of the vehicle cabin. The rear-firing speaker cone can be packaged with an acoustic lens or horn to improve dispersion characteristics.

According to one embodiment, bidirectional speaker 300 includes primary woofer cone 305, primary tweeter cone 310, and primary motor structure 315 forming a first loudspeaker to direct sound in a first direction 335, and bidirectional speaker 300 also includes secondary motor structure 320, secondary tweeter cone 325 and sound guide 330 forming a second loudspeaker to direct sound in a second direction 340. FIG. 3 shows a motor structure of the first loudspeaker is coupled to the motor structure of the second loudspeaker. The first direction 335 associated with the loudspeaker is opposite the second direction 340 associated with the second loudspeaker. Sound guide 330 may relate to an acoustic horn in one embodiment. In another embodiment, sound guide 330 is a dispersion louver according to another embodiment.

According to one embodiment, bidirectional speaker 300 enables integrated acoustic performance for both inside and outside of a vehicle cabin. In addition, bidirectional speaker 300 can allow for simplification of packaging of speakers while keeping complexity and amplifier channels to a minimum. The rear-firing (e.g., external) speaker can have an integrated acoustic horn or lens to promote desired dispersion characteristics.

According to one embodiment, bidirectional speaker 300 may be mounted in a vehicle, such as a vehicle door panel, wherein the primary woofer cone 305, primary tweeter cone 310, and primary motor structure 315 to provide sound to the interior cabin of the vehicle. The secondary motor structure 320, secondary tweeter cone 325 and sound guide 330 may be configured to direct sound externally of the vehicle. In certain embodiments, sound output by the primary woofer cone 305, primary tweeter cone 310, and primary motor structure 315 may be different than sound output by the secondary motor structure 320, secondary tweeter cone 325 and sound guide 330. By way of example, the secondary motor structure 320, secondary tweeter cone 325 and sound guide 330 may provide sound for external car audio applications. By way of example bidirectional speaker 300 may be employed for an electronic vehicle to identify the presence of the vehicle and other safety situations for silent electric vehicles. External audio applications may also include social environments such as tailgates, parties, or a worksite where users may desire to broadcast their content outside of the vehicle. As such, bidirectional speaker 300 provides a transducer technology for inside and outside of a vehicle.

Figure 4:
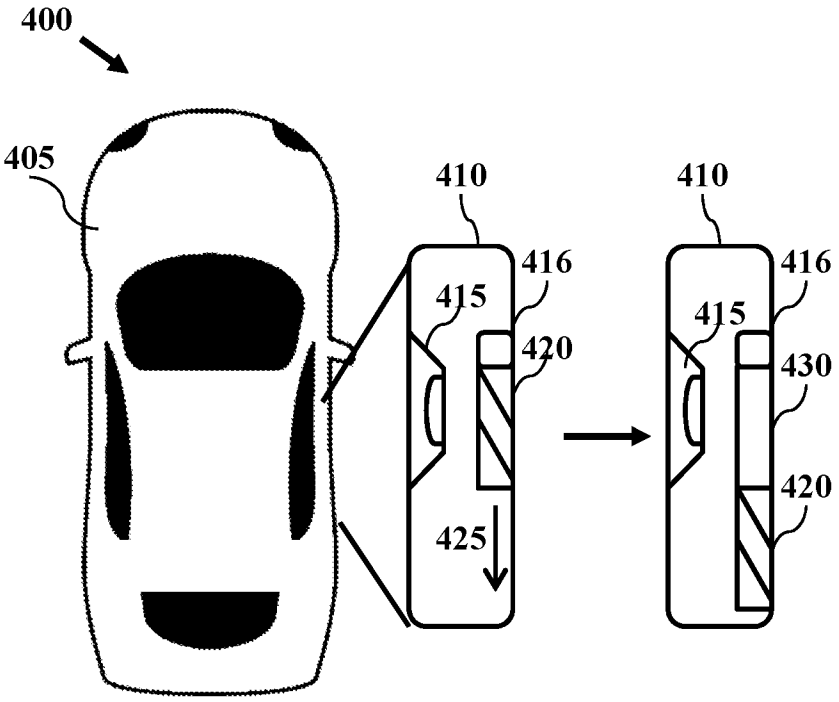
FIG. 4 depicts a graphical representation of speaker system according to one or more embodiments.

FIG. 4 depicts a graphical representation of speaker system according to one or more embodiments. System 400 provides for a mechanism to allow for speaker output to more easily disperse from a vehicle door panel. System 400 allows for in-vehicle acoustic systems to utilize externally coupled subwoofer solutions (ECS), where the front of the woofer cone is acoustically presented to vehicle occupants, while the back of the cone acoustically "sees" the outside world. System 400 enables significant performance improvements and weight savings over traditional subwoofer solutions, however primary the disadvantage is introduction of audible noise to the outside world. Additionally, an external facing speaker cone of system 400 can also be exposed to environmental weathering, which can present a problem during extreme conditions such as water, snow, ice, heat, or particulates (mud, dirt, rocks).

In one embodiment, system 400 is an automated acoustic woofer ventilation and environmental coupling mechanism. The mechanized shudder or venting solution enables the system to vent the woofer outside of the car under normal conditions, but also seal off the exterior world in situations where environmental noises are an issue, or when the speaker needs additional protection from the environment.

According to one embodiment, system 400 may be provided for a vehicle, such as vehicle 405, to allow for a movable element associated with the position of a speaker. System 400 is described with reference to a door panel 410 of vehicle 405, however it should be appreciated that similar configuration may be provided to other parts of a vehicle. In system 400, a speaker is installed in portion of the vehicle. According to one embodiment, speaker 415 is installed in panel 410. According to another embodiment, system 400 includes actuator 416 configured to displace element 420 to allow for an opening associated with a back side of the speaker 415 and in the door panel 410. According to one embodiment actuator 416 may move element 420 in direction 425. As shown in FIG. 4, actuator 416 displaces panel 420 to reveal opening 430 in door panel 410. Opening 430 is located in a position of door panel 410 near an external facing cone of speaker 415 according to one embodiment. System 400 may be applied to bidirectional speakers and forward facing speakers.

According to one embodiment, actuator relates to one or more of a motor, servo control and/or moveable element configured to displace element 420 from opening 430 by one or more of sliding, rotation, deployment and multidirectional movement in one or more planes. Element 430 may relate to a section of material associated with the door panel (e.g., metal, plastic, etc.). In certain embodiments, element 420 may include a plurality of movable louvers.

In one embodiment, element 420 is a sliding door or shudder system be used to open or close the rear-chamber of the speaker 415 (e.g., woofer) to the outside world. Element 420 may be motor-controlled to enable automatic switching of the two acoustic configurations. The acoustic aperture could be completely open, providing a true ECS acoustic mounting scheme, completely closed, providing a traditional sealed box acoustic mounting scheme, or partially opened to adjust acoustic performance as needed. System 400 may be applied to subwoofers, door woofers, midranges, and/or tweeters.

Figure 5B:
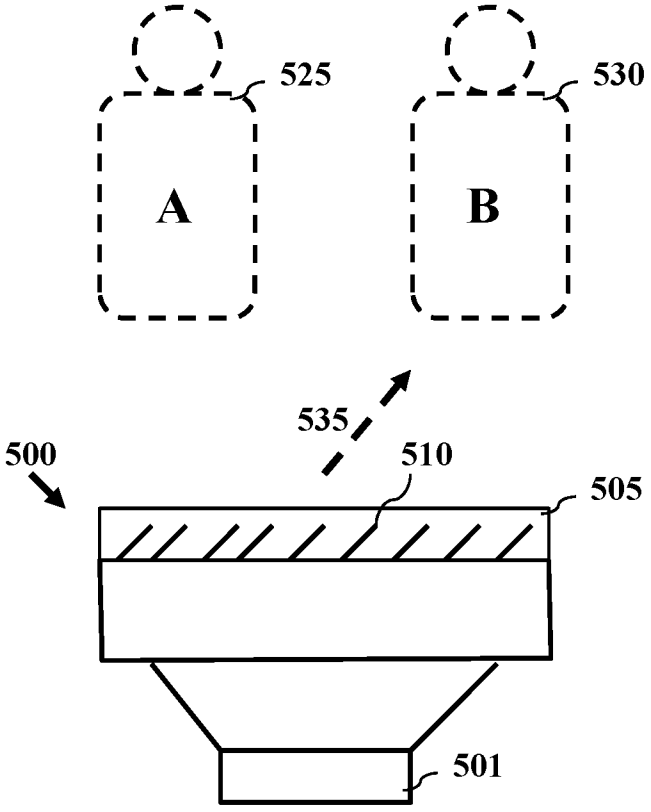
FIGS. 5A-5C depict a directional speaker configuration according to one or more embodiments.
Figure 5A:
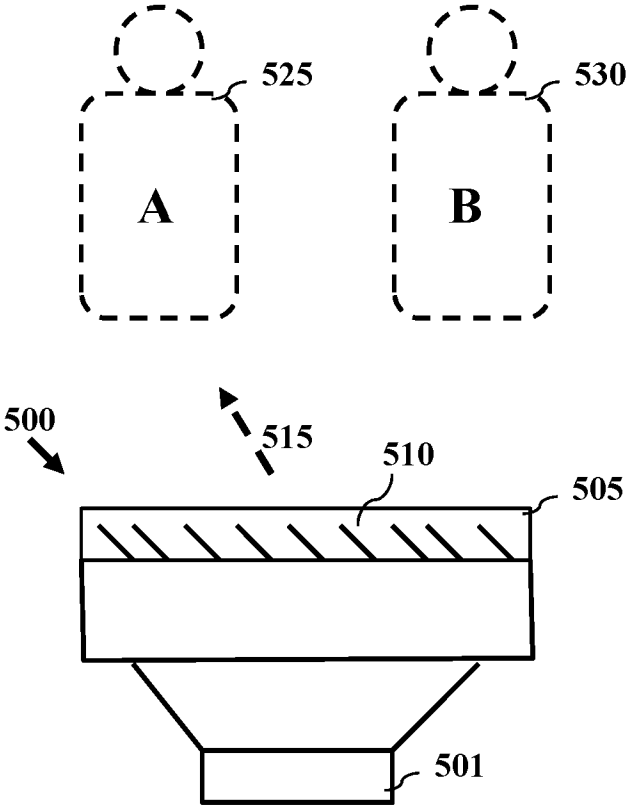
Figure 5C:
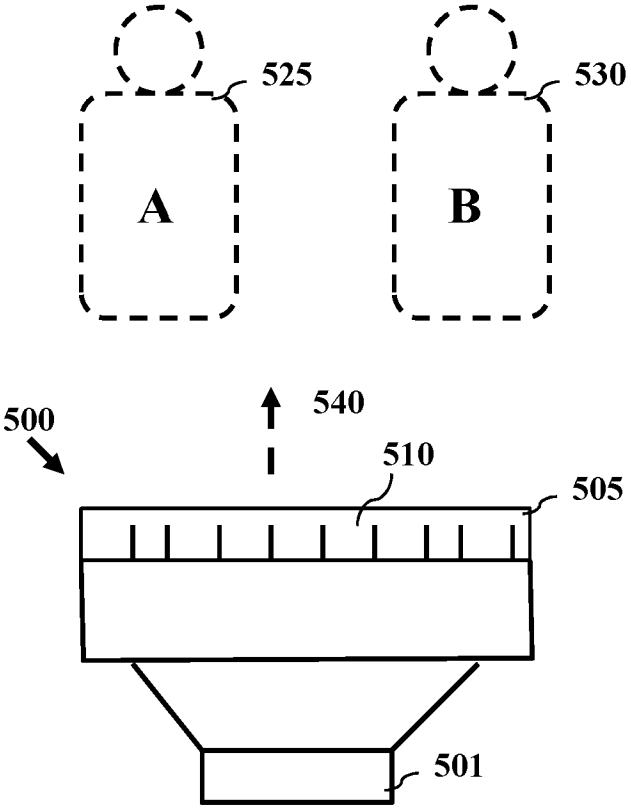

FIGS. 5A-5C depict a directional speaker configuration according to one or more embodiments. According to one embodiment, a directional speaker 500 includes a loudspeaker and directional element 505. Directional element 505 includes a plurality of movable elements 510. According to one embodiment, directional element 505 allows for passive directivity of a loudspeaker to be changed automatically to address changing needs of the user. This also has use cases outside of the car, such as audio outside of the vehicle cabin or other structure. Directional speaker 500 may overcome the limitations of speaker configurations that provide an acoustic isolation system, such as ISZ (Independent Sound Zones), which may be largely based on passive directivity of a speaker.

FIGS. 5A-5C depict an automated loudspeaker louver system for dispersion control according to one more embodiments. According to one embodiment, a loudspeaker configuration is provided including a directional element. In one embodiment, the directional element is coupled to the loudspeaker. According to another embodiment, the directional element is arranged in a position near the output area of the speaker, such as the cone. FIGS. 5A-5C show loudspeaker 501 including a directional element 505 according to one or more embodiments. According to one embodiment, directional element 505 is coupled to the loudspeaker 501. Directional element 505 can includes a plurality of movable elements configured for passive directivity of output of the loudspeaker based on the positioning of the movable elements. By way of example, the movable elements include a surface or surfaces, that act as a waveguide for output of the loudspeaker, such that positioning of the movable elements may direct the output of the loudspeaker in one or more directions. According to one embodiment, moveable elements of the directional element 505 are configured to direct sound in at least one of a straight direction (e.g., in line the output position of the loudspeaker) and a rotated position. In certain embodiments, directional element 505 may be configured to direct sound output to at least a first passenger, and a second passenger. The movable elements of the directional element 505 may be are configured to rotate to a left position, center position, and right position According to one embodiment, directional element 505 may include a housing and a plurality of uniform moveable elements arranged in the housing.

Directional element 505 provides an automated mechanism with a dispersion-controlling louver system to adjust the directionality and acoustic dispersion of loudspeaker 501. The louver system of directional element 505 may include a series of parallel slats, such as element 510, that direct acoustic pressure for high frequencies. For a simple example, with listeners in the front two seats of a vehicle, FIG. 5A depicts configuration direction of sound to listener A, passenger 525, while the configuration of FIG. 5B directs the sound to listener B, passenger 530.

According to one embodiment, directional element 505 may move a plurality of movable elements to direct sound. FIG. 5A depicts moveable elements 510 positioned to direct output of the speaker 501 in direction 515 to focus the sound output towards a particular passenger 525, listener A of a vehicle. FIG. 5B depicts moveable elements 510 positioned to direct output of the speaker 501 in direction 535 to focus the sound output towards a particular passenger 530, listener B of a vehicle. FIG. 5C depicts movable elements 510 positioned to direct output of the speaker 501 in direction 540 to focus the sound output towards both passenger 525 and passenger 530. In one embodiment, movable elements 510 include a moveable louver system mounted to the loudspeaker. By way of example, the movable louver system includes a plurality of parallel slat elements configured to be positioned in a plurality of positions. The plurality of slat elements are configured to direct sound output by the loudspeaker based on the position of slat elements. According to another embodiment, directional element 505 includes a moveable louver system mounted to the loudspeaker. The movable louver system can include a plurality of parallel slat elements configured to be positioned in a plurality of positions, wherein the plurality of slat elements are configured to direct sound output by the loudspeaker based on the position of slat elements. In one embodiment, movable elements 510 move as a unit to direct output of the loudspeaker in at least one direction. The movable elements 510 can rotate on center rotate on ends, or move based on at least one of rotation and sliding.

In one embodiment, movable elements 510 are configured to function as a louver for acoustic dispersion such that movable elements 510 each rotate as a unit and all rotate or move together.

While this disclosure has been particularly shown and described with references to exemplary embodiments thereof, it will be understood by those skilled in the art that various changes in form and details may be made therein without departing from the scope of the claimed embodiments.

What is claimed is:

1. A loudspeaker configuration for a vehicle comprising:

a loudspeaker in a door panel of the vehicle, wherein the loudspeaker is a bidirectional loudspeaker including a first loudspeaker and a second loudspeaker arranged in a coaxial arrangement in the door panel, the first loudspeaker and the second loudspeaker positioned between a first side of the door panel and a second side of the door panel that is opposite the first side, and wherein the second side of the door panel is positioned between the loudspeaker and an environment outside of the vehicle;

a directional element coupled to the loudspeaker, wherein the directional element includes a plurality of movable elements configured for passive directivity of output of the loudspeaker based on a positioning of the movable elements; and a second movable element arranged at a back side of the loudspeaker and at the second side of the door panel, wherein the second movable element is configured for displacement to open the back side of the loudspeaker and to provide an opening in the door panel that exposes the second loudspeaker to the environment outside of the vehicle.

2. The loudspeaker configuration of claim 1, wherein the directional element includes a housing and a plurality of uniform elements arranged in the housing, and wherein the uniform elements of the directional element are configured to rotate to a left position, a center position, and a right position.

3. The loudspeaker configuration of claim 1, wherein the directional element includes a movable louver system mounted to the loudspeaker, the movable louver system including a plurality of parallel slat elements configured to be positioned in a plurality of positions, and wherein the plurality of slat elements is configured to direct sound output by the loudspeaker based on the position of the slat elements.

4. The loudspeaker configuration of claim 1, wherein the plurality of movable elements moves as a unit to direct output of the loudspeaker in at least one direction.

5. The loudspeaker configuration of claim 1, wherein the directional element is mounted to a cone of the loudspeaker, wherein the directional element includes the plurality of movable elements configured based on a shape of the cone, and wherein the plurality of movable elements provide a waveguide for audio output of the loudspeaker to provide passive directivity through acoustic dispersion.

6. The loudspeaker configuration of claim 1, wherein the second loudspeaker is configured to output sound in a second direction, and wherein the second loudspeaker is arranged in a coaxial arrangement with the first loudspeaker and the directional element.

7. A bidirectional loudspeaker comprising:

a first loudspeaker configured to output sound in a first direction; and a second loudspeaker configured to output sound in a second direction, wherein the first loudspeaker and the second loudspeaker are arranged in a coaxial arrangement in a door panel of a vehicle, the first loudspeaker and the second loudspeaker positioned between a first side of the door panel and a second side of the door panel that is opposite the first side, and wherein the second side of the door panel is positioned between the first and second loudspeakers and an environment outside of the vehicle, wherein the first loudspeaker is configured to output sound to a vehicle interior and wherein the second loudspeaker is configured to output sound to a vehicle exterior; and a movable element associated with the position of the second loudspeaker and positioned at the second side of the door panel to allow for an opening associated with the second loudspeaker, wherein the movable element is controlled for displacement to provide an opening for the second loudspeaker in the door panel that exposes the second loudspeaker to the environment outside of the vehicle.

8. The bidirectional speaker of claim 7, wherein the movable element is moved by an actuator to reveal an opening in the door panel.

9. The bidirectional speaker of claim 8, wherein the second loudspeaker is configured to output environmental sound outside of the vehicle.

10. The bidirectional speaker of claim 8, wherein the bidirectional loudspeaker is configured to operate with a movable element for the second loudspeaker.

11. The bidirectional speaker of claim 10, wherein the movable element provides speaker venting for the second loudspeaker in a vehicle door.

12. The bidirectional speaker of claim 7, wherein the first loudspeaker includes a movable louver system mounted to the first loudspeaker, the movable louver system including a plurality of parallel slat elements configured to be positioned in a plurality of positions, and wherein the plurality of slat elements is configured to direct sound output by the first loudspeaker based on the position of the slat elements.

13. The bidirectional speaker of claim 7, wherein the first loudspeaker includes an acoustic horn to direct sound inside of the vehicle and the second loudspeaker includes an acoustic horn to direct sound outside of a vehicle.

14. The bidirectional speaker of claim 7, wherein a motor structure of the first loudspeaker is coupled to a motor structure of the second loudspeaker.

15. The bidirectional speaker of claim 7, wherein the first direction associated with the first loudspeaker is opposite the second direction associated with the second loudspeaker.

16. A method for controlling a loudspeaker and a movable element in a vehicle comprising:

detecting a control setting for the loudspeaker and a movable element associated with the loudspeaker; and controlling the movable element in a door panel of the vehicle in response to the control setting, wherein the movable element is adjusted to direct output of the loudspeaker, wherein the loudspeaker includes a first loudspeaker configured to output sound to a vehicle interior and a second loudspeaker configured to output sound to a vehicle exterior, wherein the loudspeaker is positioned between a first side of the door panel and a second side of the door panel that is opposite the first side, and wherein the second side of the door panel is positioned between the loudspeaker and an environment outside of the vehicle, and wherein the movable element is positioned at the second side of the door panel and controlled to allow for an opening associated with the second loudspeaker, wherein the movable element is controlled for displacement to provide an opening for the second loudspeaker in the door panel that exposes the second loudspeaker to the environment outside of the vehicle.

17. The method of claim 16, wherein controlling the movable element includes controlling a plurality of uniform elements arranged in the housing to rotate to a left position, a center position, and a right position.

18. The method of claim 16, wherein controlling the movable element includes controlling a movable louver system mounted to the loudspeaker, the movable louver system including a plurality of parallel slat elements configured to be positioned in a plurality of positions, and wherein the plurality of slat elements is configured to direct sound output by the loudspeaker based on the position of the slat elements.

19. The method of claim 16, wherein the movable element of the loudspeaker is configured to operate with a sliding door for the second loudspeaker.

20. The method of claim 16, wherein controlling includes controlling output of an outward facing sound element of a bidirectional speaker.

* * * * *